United States Patent [19]

McCracken

[11] 4,036,576

[45] July 19, 1977

[54] INCINERATION SYSTEM FOR THE DISPOSAL OF A WASTE GAS AND METHOD OF OPERATION

[75] Inventor: Charles Kennedy McCracken, Blue Bell, Pa.

[73] Assignee: The Trane Company, La Crosse, Wis.

[21] Appl. No.: 713,458

[22] Filed: Aug. 11, 1976

[51] Int. Cl.[2] ..... F23G 7/06

[52] U.S. Cl. ..... 431/5; 23/277 C; 110/8 A; 423/210; 431/29; 431/202

[58] Field of Search ..... 431/5, 202, 29, 30, 431/31, 115, 116, 9; 110/8 A; 423/210; 23/277 C

[56] References Cited

U.S. PATENT DOCUMENTS

| | | | |
|---|---|---|---|
| 3,789,104 | 1/1974 | McCauley | 23/277 C |
| 3,817,687 | 6/1974 | Cavallero et al. | 431/202 |
| 3,837,785 | 9/1974 | Evans et al. | 431/5 |
| 3,837,813 | 9/1974 | Ebeling et al. | 431/5 X |
| 3,870,474 | 3/1975 | Houston | 23/277 C |
| 3,898,317 | 8/1975 | Hemsath et al. | 431/5 X |
| 3,979,175 | 9/1976 | Kattan et al. | 431/5 |

*Primary Examiner*—Edward G. Favors
*Attorney, Agent, or Firm*—Carl M. Lewis; Peter D. Ferguson

[57] ABSTRACT

An incineration system and method are disclosed wherein a waste gas is transferred from tank means to an incinerator for disposal therein. Products of combustion discharged from the incinerator may be used (1) to heat a liquid medium for use in washing down the tank means; and (2) as an inert purge gas for application to said tank means. A control system is disclosed for the admission of fuel, combustion air, incineration air, and waste gas to said incinerator whereby a substantially constant operating temperature may be maintained therein despite variations in the quantity and heating value of waste gas admitted thereto, thus resulting in products of combustion of substantially constant quality suitable for use as a purge gas.

16 Claims, 2 Drawing Figures

INCINERATION SYSTEM FOR THE DISPOSAL OF A WASTE GAS AND METHOD OF OPERATION

BACKGROUND OF THE INVENTION

This invention has application in those installations where one or more tanks, hereafter denoted as "tank means," are employed for the storage of volatile liquids; i.e., those which exhibit a vapor pressure such that at least a partial vapor fraction is present within the tank simultaneously with the liquid fraction. In practice, such installations will commonly include not only transportation vessels such as barges, railroad cars, tank trucks and the like; but also fixed installations for the storage of such liquids. In the operation of these installations, a problem exists in that it is undesirable from an environmental point of view for waste gas from these tank means to be discharged to the atmosphere, a situation which has been recognized by the Environmental Protection Agency as evidenced by its regulations governing such discharges.

The use of an incinerator for disposal of these waste gases is recognized as an adequate solution to this problem, although it must be equipped with control means such that a suitable operating temperature and a sufficient quantity of oxygen is maintained therein despite variations in quantity and heating value of the waste gas. This is necessary in order to assure proper disposal of the waste gas. Said control means must be adequate to modulate the flow of fuel, combustion air, incineration air, and waste gas to the incinerator throughout its operating range.

Associated with the aforementioned problem of waste gas disposal is the requirement that these tank means be washed down on a periodic basis, usually before refilling, and that an inert purge gas be applied thereto in order to assure that an explosive mixture of waste gas and oxygen is not present therein.

It is thus desirable that an installation of the type described be equipped with means for disposal of waste gas from the tank means and for washing down and purging same.

SUMMARY OF THE INVENTION

The present invention comprises an incineration system which meets the above-described requirements for proper operation of a tank installation of the type described.

An incineration system is provided which includes an incinerator having means for effecting combustion and/or other oxidation therein, including conduit means for introduction of fuel, combustion air, incineration air, and waste gas thereto; said conduit means being equipped with valve means for the control of flow therethrough. A control system modulates said valve means in response to the temperature within the incinerator so as to maintain a substantially constant temperature throughout the operating range of the incinerator, thereby assuring proper disposal of the waste gas.

In order that a supply of hot liquid medium may be provided to wash down the tank means of the installation, means are provided for effecting heat exchange between products of combustion leaving the incinerator and a source of liquid medium. Conduit means direct hot liquid medium from the heat exchange means to the tank means for washing down same.

To fulfill the requirements for an inert purge gas to be applied to the tank means, means are provided whereby a portion of the products of combustion from the incinerator may be directed thereto. This aspect of the invention is enhanced through the use of the novel control system referred to above in that, through accurate temperature control of the combustion process, the resultant products of combustion will be of sufficiently low oxygen content, e.g., less than 5%, as to be suitable for use as an inert purge gas.

From the above, it will be apparent that it is an object of this invention to provide an incineration system for the disposal of a waste gas which includes a control system for modulation of fuel, combustion air, incineration air, and waste gas flow into an incinerator whereby a substantially constant temperature may be maintained therein throughout its operating range, despite variations in the quantity and heating value of waste gas available for disposal. Moreover, through the use of this control system, the products of combustion will be maintained at a quality, in terms of low oxygen content, such as to be suitable for subsequent application to the tank means as an inert purge gas.

It is a further object of the present invention to provide an incineration system for the disposal of a waste gas from tank means which also includes means for producing a hot liquid medium for use in washing down said tank means.

It is a further object of this invention to provide an incineration system for the disposal of a waste gas from tank means which also includes means for directing a portion of the products of combustion from the incinerator thereof to said tank means for application thereto as an inert purge gas, the quality of which is maintained through the use of the novel temperature control system referred to above.

It is an ultimate object of the present invention to provide an incineration system for the disposal of a waste gas from tank means which includes both means for producing a hot liquid medium for use in washing down said tank means and means for directing a portion of the products of combustion from the incinerator thereof to said tank means for application thereto as an inert purge gas.

That these and other objects of the invention have been accomplished will become apparent from the following description of a preferred embodiment and by reference to the accompanying drawings.

DESCRIPTION OF A PREFERRED EMBODIMENT

Figure 1:
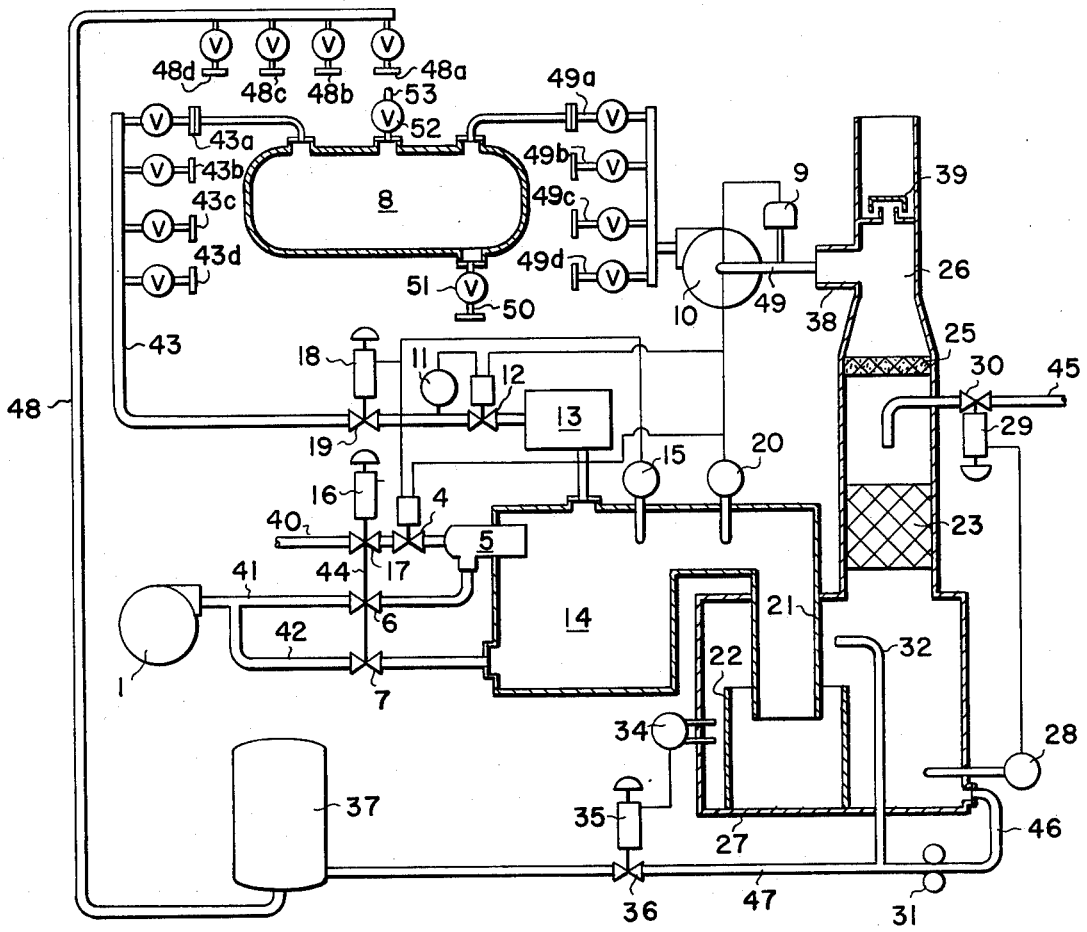
FIG. 1 is a schematic diagram showing the flow circuitry of the present invention, including the control means employed therein.

As shown in FIG. 1, the incineration system of the present invention includes an incinerator 14 which may be of conventional construction and which includes a burner 5 for effecting combustion therein. Burner 5 may be of any commercially available design and may operate utilizing either gaseous or liquid fuels.

Reference numeral 8 identifies diagramatically a single tank which represents an installation of the type described above which may include a plurality of such tanks, either of the transport vehicle type or fixed. The term "tank means" has been chosen to describe such an installation for the purposes of this application and is intended to encompass either a single or multiple tank installation.

Conduit means 43 is provided to connect tank means 8 with incinerator 14 such that waste gas may be transferred thereto for disposal. In practice, conduit means 43 and tank means 8 would be provided with suitable quick-disconnect couplings in order to facilitate operation of the system. Moreover, in the case of a multiple tak installation, conduit means 43 may be provided with a plurality of input lines shown diagramatically at 43*a* through 43*d*, thus serving as a manifold for the collection of waste gas from more than one tank at a time.

Interposed within conduit means 43 is control valve 19, the operation of which will be described below. Waste gas shut-off valve 12 is also interposed in conduit means 43 and is controlled by pressure responsive switch 11 so as to prevent back flow from incinerator 14 to tank means 8. As an added safety precaution, flame arrestor 13 is provided to avoid the possibility of flashback from the incinerator.

Fuel and combustion air are supplied to burner 5 and thus to incinerator 8 by conduits 40 and 41 under the control of valves 17 and 6, respectively. Similarly, incineration air is supplied directly to incinerator 14 via conduit 42 which includes control valve 7. It may be noted that a common blower 1 supplies both combustion air and incineration air to respective conduits 41 and 42.

Operation of valves 19, 17, 6 and 7 is under control of valve operators 18 and 16 which respond to the temperature within incinerator 14 in the following manner:

In order to start up the incineration system, blower 1 is started, fuel shut-off valve 4 opened, and burner 5 ignited in order to establish an operating temperature with incinerator 8. This having been accomplished, blower 10 will be permitted to start up as soon as oxygen analyzer 9 senses a low oxygen content (e.g., less than 5%) in the products of combustion, thereby pressurizing tank means 8 and conduit means 43, 43*a*, and causing pressure responsive switch 11 to open waste gas shut-off valve 12, resulting in the admission of waste gas to incinerator 14.

Figure 2:
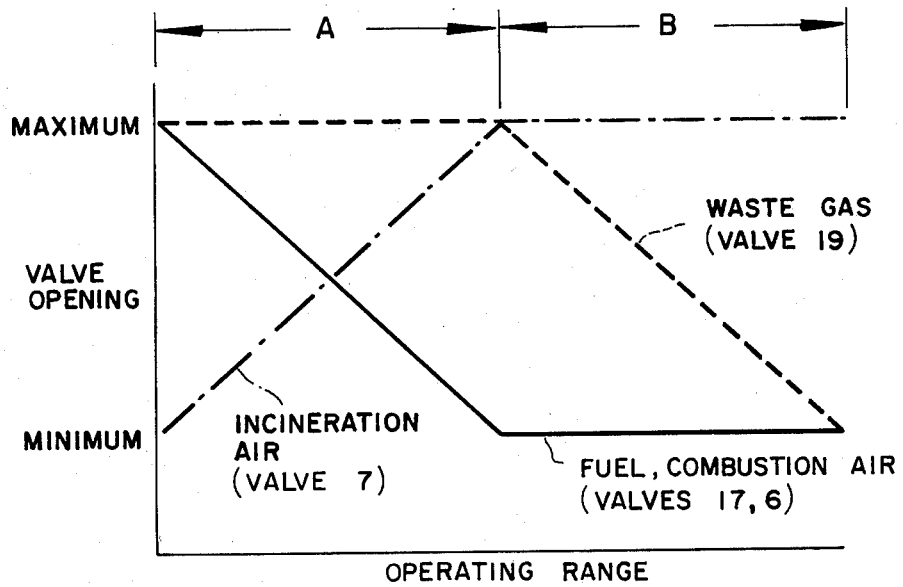
FIG. 2 is a chart which plots the relative valve openings, as dictated by the control means, throughout the operating range of the incineration system.

At this time, valves 17 and 6, controlling the flow of fuel and combustion air, respectively, will be in their position of maximum flow; valve 7 will be in its position limiting incineration air flow to a minimum value; and valve 19 will be at its maximum opening allowing full flow of waste gas to the incinerator. This mode of operation is depicted in FIG. 2 at the left-most portion of the operating range.

Since the waste gas entering incinerator 14 will generally be of at least some heating value, and in many cases of considerable heating value, a temperature rise will occur upon its admission to incinerator 14. Temperature controller 15 will sense this rise and produce a signal to valve operator 16, effecting a simultaneous modulation of valves 17 and 6 in a closing direction and valve 7 in an opening direction, thus reducing the amount of fuel and combustion air which is admitted to the incinerator while increasing the amount of incineration air. This mode of operation, wherein valves 17, 6 and 7 are continuously modulated in order to maintain a substantially constant operating temperature within the incinerator, is represented in the graph of FIG. 2 as part of "A" of the operating range.

Should the quantity and/or heating value of the waste gas result in continued temperature increases in the incinerator, valves 6 and 17 will eventually reach their positions of minimum fuel/combustion air flow and valve 7 its position of maximum incineration air flow. At this point, temperature controller 15 will be operative to begin modulating valve 19 from its position of maximum waste gas flow, thus initiating part "B" of the operating range as seen in FIG. 2. This mode of operating will continue until the quantity and/or heating value of the waste gas decreases. In the unlikely event that valve 19 modulated to its position of minimum flow and the temperature in incinerator 14 continues to increase, excess temperature switch 20 will cause the system to shut down, as by de-energizing blower 10 and closing valves 12 and 14.

The components to be utilized in this control system, including temperature controller 15, valves 17, 6, 7, 19; and valve operators 16, 18 may be off-the-shelf items and may be either pneumatically or electrically operated. As shown in FIG. 1, it is preferred that valves 17, 6 and 7 be operated by a common valve operator 16 through the use of an element 44 which links the actuators of valves 17, 6 and 7 with valve operator 16.

It will be appreciated from the above description of the instant control system that control of the incineration system is afforded over a wide operating range, as illustrated by the chart of FIG. 2. This is especially desirable in installations of the type under consideration wherein a plurality of tanks are present, any number of which may require treatment at a given time and thus supplying widely varying amounts of waste gas to the incinerator. Through the modulation of fuel, combustion air, incineration air, and waste gas flow in response to temperature within the incinerator, stable operating of the system is attained while ensuring proper disposal of the waste gas. Further, the products of combustion will be maintained at a quality in terms of low oxygen content so as to be suitable for application to the tank means as an inert purge gas.

In addition to the novel control system described above, the incineration system of the present invention also includes means for heating a liquid medium for use in washing down the tank means and means for directing a portion of the products of combustion from the incinerator to the tank means for application thereto as an inert purge gas, as will be hereinafter described.

Products of combustion are discharged from incinerator 14 into a downcomer 21, the lower end of which is submerged within a weir 22 containing a supply of liquid medium to be heated. In this manner, heat exchange means are provided whereby, through direct contact with the liquid medium, heat from the products of combustion is transferred to the liquid medium.

The liquid medium, which may comprise water, is supplied to the heat exchange means via conduit 45 which discharges the liquid through a recuperator 23 and into tank 27, separator 25 preventing the carryover of droplets by the gas stream. A conduit 46 which communicates with a lower portion of tank 27 withdraws liquid medium therefrom by means of a pump 31, directing a portion thereof to conduit 32 for application to downcomer 21 as a coolant and thereafter into weir 22 for further heating. That portion of liquid medium which is not recirculated to weir 22 is directed by conduit 47 to storage tank 37 and then via conduit means 48 to tank means 8 for use in washing down same. It will be appreciated that conduit means 48 would, in practice, comprise a manifold having individual conduits connected thereto for distribution of hot liquid medium to each tank location of the installation, as shown diagramatically in FIG. 1 at 48*a* through 48*d*.

The temperature of liquid medium leaving tank 27 is monitored by temperature controller 28 which emits a signal to operator 29 of inlet liquid control valve 30 so as to maintain a proper temperature. Level controller 34 disposed within tank 27 is operative to control the level of liquid medium therein by causing control valve 36 to open and close under the influence of operator 35, thereby causing the transfer of hot liquid medium from tank 27 to storage tank 37.

In order that a source of purge gas be provided for application to tank means 8, a tee connection 38 is located on exhaust stack 26 in order to draw off a portion of the products of combustion discharged from incinerator 14. Since these gases are deficient in oxygen, they will be suitable for use as an inert purge gas without creating the possibility of a combustible mixture being produced in the tank means.

A conduit means 49 is connected to tee 38 and includes a blower 10 for directing the products of combustion to tank means 8 for application thereto as a purge gas. As with the case of liquid medium conduit means 48, conduit means 49 would typically comprise a manifold having a plurality of conduits connected thereto for connection to individual tanks of the installation, shown diagramatically at 49*a* through 49*d* of FIG. 1. In order to assure that no oxygen is introduced into the tank means, an oxygen analyzer 9 is provided which continuously senses for the presence of oxygen in conduit means 49, shutting down blower 10 in that event.

Exhaust stack 26 is equipped with a seal 39 which prevents blower 10 from drawing atmospheric gases down into the stack, a condition which could cause oxygen analyzer 9 to shut down blower 10.

Having described the structural features going to make up the incineration system of the present invention, its method of operation will be described with respect to one possible installation.

Assuming tank means 8 to be filled with a liquid, such as a hydrocarbon solvent, which it is desired to drain therefrom, valve 51 on drain conduit 50 is opened. At the same time, purge gas is admitted to an upper portion of the tank means via conduit means 49, 49*a* so as to displace the liquid solvent as it is removed therefrom. When tank means 8 is empty, the supply of purge gas is discontinued and drain conduit 50 placed in communication with a disposal sewer. Hot water is then admitted to the tank means via conduit means 48, 48*a* to wash it down and remove all traces of the liquid therefrom. Since tank means 8 will thereafter contain some remaining vapors, purge gas is again admitted thereto via conduit means 49, 49*a* and vented to incinerator 8 through conduit means 43, 43*a*, thus removing any residual vapors therefrom and effectively disposing of them.

When it is desired to refill tank means 8, which may occur at a later date, the empty tank means is again purged to remove any oxygen fraction therefrom. Then the liquid is introduced thereto via fill conduit 53, during which time conduit means 43, 43*a* remain in communication with tank means 8 so as to remove and dispose of vapors which are displaced as the level rises within tank means 8.

From the above description of a preferred embodiment, it is apparent that an improved incineration system for the disposal of a waste gas has been disclosed in a manner so as to enable one of ordinary skill in the art to make and practice the invention. While the invention has been described with respect to a preferred embodiment, it is to be understood that modifications thereto will be apparent to those skilled in the art within the scope of the invention, as defined by the claims which follow.

I claim:

1. A method of operating an incinerator for the disposal of a waste gas comprising the steps of:

a. admitting fuel and combustion air to said incinerator for combustion therein;

b. admitting waste gas and incineration air to said incinerator; and c. modulating the flow of fuel, combustion air and incineration air to said incinerator between predetermined minimum and maximum values in response to temperature changes within said incinerator, an increase in temperature resulting in decreased fuel and combustion air flow and increased incineration air flow.

2. The method of claim 1 further including the step of decreasing the flow of waste gas to said incinerator in response to further temperature increases therein at a time when the flow of fuel and combustion air have reached their minimum values and the flow of said incineration air has reached its maximum value.

3. An incineration system for the disposal of a waste gas comprising:

a. an incinerator;

b. first conduit means including first valve means for the introduction of fuel to said incinerator;

c. second conduit means including second valve means for the introduction of combustion air to said incinerator;

d. third conduit means including third valve means for the introduction of incineration air to said incinerator;

e. fourth conduit means including fourth valve means for the introduction of waste gas to said incinerator; and f. control means for operation of said first through third valve means whereby flow therethrough is modulated between predetermined minimum and maximum values in response to temperature changes within said incinerator, an increase in temperature resulting in decreased flow through said first and second valve means and increased flow through said third valve means.

4. The incineration system of claim 3 wherein said control means is further operative to decrease the flow through said fourth valve means in response to a further temperature increase within said incinerator at a time when the flow through said first and second valve means have reached their minimum values and the flow through said third valve means has reached its maximum value.

5. The incineration system of claim 3 wherein said control means includes an element linking actuators of said first through third valve means and coupled to a valve operator, whereby a single valve operator may be employed in order to effect simultaneous control of said first through third valve means.

6. The incineration system of claim 3 further including exhaust conduit means for transferring products of combustion from said incinerator to the atmosphere and gas conduit means for the transfer of products of combustion from said exhaust conduit means to said tank means for application thereto as an inert purge gas.

7. An incineration system for the disposal of a waste gas from tank means and for producing a hot liquid medium for washing down said tank means; said system comprising:

a. an incinerator having means for effecting combustion therein;
b. tank means containing a waste gas;
c. first conduit means for the transfer of waste gas from said tank means to said incinerator;
d. discharge means for the transfer of products of combustion from said incinerator, including heat exchange means whereby a liquid medium may be heated by said products of combustion; and
e. liquid conduit means for the transfer of hot liquid medium from said heat exchange means to said tank means, whereby said tank means may be washed down by said liquid medium.

8. The incineration system as set forth in claim 7 wherein said heat exchange means comprises a vessel containing a quantity of said liquid medium and a conduit having an open end submerged therein for discharge of said products of combustion thereinto in direct heat exchange relationship with said liquid medium.

9. The incineration system as set forth in claim 7 wherein said liquid conduit means includes a pump and storage vessel.

10. An incineration system for the disposal of a waste gas from tank means and for producing an inert purge gas for application to said tank means; said system comprising:

a. an incinerator having means for effecting combustion therein;
b. tank means containing a waste gas;
c. first conduit means for the transfer of waste gas from said tank means to said incinerator;
d. exhaust conduit means for transferring products of combustion from said incinerator to the atmosphere; and
e. gas conduit means for the transfer of products of combustion from said exhaust conduit means to said tank means for application thereto as an inert purge gas.

11. The incineration system as set forth in claim 10 wherein said gas conduit means includes a blower.

12. The incineration system as set forth in claim 11 further including means for analyzing the products of combustion in said gas conduit means and for shutting down said blower upon the presence of excess oxygen therein.

13. An incineration system for the disposal of a waste gas from tank means, for producing a hot liquid medium for washing down said tank means, and for producing an inert purge gas for application to said tank means; said system comprising:

a. an incinerator having means for effecting combustion therein;
b. tank means containing a waste gas;
c. first conduit means for the transfer of waste gas from said tank means to said incinerator;
d. discharge means for the transfer of products of combustion from said incinerator, including heat exchange means whereby a liquid medium may be heated by said products of combustion;
e. liquid conduit means for the transfer of hot liquid medium from said heat exchange means to said tank means, whereby said tank means may be washed down by said liquid medium;
f. exhaust conduit means for the transfer of products of combustion from said discharge means to the atmosphere; and
c. a gas conduit means for the transfer of products of combustion from said exhaust conduit means to said tank means for application thereto as an inert purge gas.

14. The incineration system of claim 13 wherein said incinerator includes:

a. first conduit means including first valve means for the introduction of fuel to said incinerator;
b. second conduit means including second valve means for the introduction of combustion air to said incinerator;
c. third conduit means including third valve means for the introduction of incineration air to said incinerator;
d. fourth conduit means including fourth valve means for the introduction of waste gas to said incinerator; and
e. control means for operation of said first through third valve means whereby flow therethrough is modulated between predetermined minimum and maximum values in response to temperature changes within said incinerator, an increase in temperature resulting in decreased flow through said first and second valve means and increased flow through said third valve means.

15. The incineration system of claim 14 wherein said control means is further operative to decrease the flow through said fourth valve means in response to a further temperature increase within said incinerator, at a time when the flow through said first and second valve means have reached their minimum values and the flow through said third valve means has reached its maximum value.

16. A method of operating an incineration system for the disposal of a waste gas from tank means, for producing a hot liquid medium for washing down said tank means, and for producing an inert purge gas for application to said tank means; said method comprising the steps of:

a. effecting combustion within an incinerator while admitting thereto a waste gas from tank means for disposal;
b. passing the resultant products of combustion from said incinerator in heat exchange with a liquid medium;
c. transferring the heated liquid medium to said tank means for use in washing down said tank means; and
d. directing a portion of said products of combustion following said heat exchange step to said tank means for application thereto as an inert purge gas.

* * * * *

UNITED STATES PATENT OFFICE

CERTIFICATE OF CORRECTION

PATENT NO. : 4,036,576

DATED : July 19, 1977

INVENTOR(S) : Charles Kennedy McCracken

It is certified that error appears in the above-identified patent and that said Letters Patent are hereby corrected as shown below:

In Column 8, line 12 "c." should read --g.--.

Signed and Sealed this

Fourth Day of October 1977

[SEAL]

*Attest:*

RUTH C. MASON
*Attesting Officer*

LUTRELLE F. PARKER
*Acting Commissioner of Patents and Trademarks*